US008685231B2

(12) United States Patent
Van De Graaf et al.

(10) Patent No.: US 8,685,231 B2
(45) Date of Patent: Apr. 1, 2014

(54) PROCESS FOR CONVERSION OF PARAFFINIC FEEDSTOCK

(75) Inventors: Jolinde Machteld Van De Graaf, The Hague (NL); Arend Hoek, Amsterdam (NL); Johannes Petrus De Jonge, Amsterdam (NL); Wiebe Sjoerd Kijlstra, Amsterdam (NL); Antonius Adrianus Maria Roovers, Ltd Pulua Bukom (SG); Jelle Rudolf Anne Sietsma, Amsterdam (NL); Johannes Anthonius Robert Van Veen, Amsterdam (NL)

(73) Assignee: Shell Oil Company, Houston, TX (US)

( * ) Notice: Subject to any disclaimer, the term of this patent is extended or adjusted under 35 U.S.C. 154(b) by 515 days.

(21) Appl. No.: 12/952,986

(22) Filed: Nov. 23, 2010

(65) Prior Publication Data

US 2011/0139678 A1 Jun. 16, 2011

(30) Foreign Application Priority Data

Nov. 27, 2009 (EP) ..... 09177299

(51) Int. Cl.
*C10G 47/14* (2006.01)
*C07C 4/06* (2006.01)

(52) U.S. Cl.
USPC ..... 208/60; 208/111.35; 208/950; 585/752

(58) Field of Classification Search
USPC ..... 208/60, 95, 110, 111.35, 134, 950; 585/253, 752
See application file for complete search history.

(56) References Cited

U.S. PATENT DOCUMENTS

| | | | | |
|---|---|---|---|---|
| 4,983,273 | A * | 1/1991 | Kennedy et al. | 208/89 |
| 5,228,979 | A | 7/1993 | Ward | 208/111 |
| 5,976,351 | A | 11/1999 | Apelian et al. | 208/27 |
| 6,261,441 | B1 * | 7/2001 | Gentry et al. | 208/58 |
| 6,558,647 | B2 | 5/2003 | Lacombe et al. | 423/702 |
| 6,635,681 | B2 * | 10/2003 | Moore et al. | 518/700 |
| 6,712,953 | B1 * | 3/2004 | Kasztelan et al. | 208/111.01 |
| 6,762,143 | B2 | 7/2004 | Shan et al. | 502/63 |
| 7,048,845 | B2 | 5/2006 | Bauer | 208/111.01 |
| 7,169,291 | B1 | 1/2007 | Wang | 208/109 |
| 7,510,644 | B2 | 3/2009 | Overbeek et al. | 208/120.01 |
| 7,534,340 | B2 * | 5/2009 | Calemma et al. | 208/107 |
| 7,704,378 | B2 * | 4/2010 | Benazzi et al. | 208/108 |
| 8,137,532 | B2 * | 3/2012 | Euzen et al. | 208/111.3 |
| 2003/0173252 | A1 * | 9/2003 | Vaarkamp | 208/111.35 |
| 2004/0045871 | A1 | 3/2004 | Bauer | 208/111.01 |
| 2006/0052236 | A1 | 3/2006 | Angevine et al. | 502/66 |
| 2006/0065575 | A1 | 3/2006 | Benard et al. | 208/58 |
| 2006/0144755 | A1 * | 7/2006 | Benazzi et al. | 208/108 |
| 2011/0155633 | A1 * | 6/2011 | Simon et al. | 208/60 |

FOREIGN PATENT DOCUMENTS

| | | | |
|---|---|---|---|
| CN | 101177619 | 5/2008 | C10G 47/00 |
| GB | 2077289 | 12/1981 | C07C 1/04 |
| WO | WO03045548 | 6/2003 | B01J 29/70 |
| WO | WO2004002623 | 1/2004 | B01J 29/76 |
| WO | WO2004053027 | 6/2004 | C10G 45/62 |
| WO | WO2005042148 | 5/2005 | B01J 29/70 |
| WO | WO2006029137 | 3/2006 | B01J 29/00 |

OTHER PUBLICATIONS

EPO Translation of CN 101177619, Obtained May 9, 2013.*
Group_(periodic_table), http://en.wikipedia.org/wiki/Group_(periodic_table), Obtained May 7, 2013.*
J M Newsman, et al. "Structural Characterization of Zeolite Beta", Proc. R. Soc. Lond. A 1988, vol. 420, p. 375.

* cited by examiner

*Primary Examiner* — Nina Bhat
*Assistant Examiner* — Jonathan Miller

(57) ABSTRACT

The invention provides a process for converting a paraffinic feedstock comprising at least 50 wt % of compounds boiling above 370° C., a paraffin content of at least 60 wt %, an aromatics content below 1 wt %, a naphthenic content below 2 wt %, a nitrogen content below 0.1 wt %, and a sulphur content below 0.1 wt %, comprising: (a) reacting the feedstock with hydrogen at a temperature between 175 and 400° C. and a pressure between 20 and 100 bar using a catalyst comprising 0.005 to 5.0 wt % of a Group VIII noble metal on a carrier comprising 0.1-15 wt % zeolite beta and at least 40 wt % amorphous silica-alumina (b) withdrawing the effluent (c) subjecting the effluent to a fractionation step to form a heavy fraction, an intermediate fraction, and a light fraction; and (d) providing at least part of the heavy fraction to the reaction zone.

8 Claims, No Drawings

PROCESS FOR CONVERSION OF PARAFFINIC FEEDSTOCK

This application claims the benefit of European Application No. 09177299.6 filed Nov. 27, 2009 which is incorporated herein by reference.

BACKGROUND OF THE INVENTION

The present invention pertains to a process for the conversion of a paraffinic feedstock, in particular for the conversion of a paraffinic feedstock derived from a Fischer-Tropsch synthesis process.

In a Fischer-Tropsch process, synthesis gas is fed into a reactor where it is converted over a suitable catalyst at elevated temperature and pressure to paraffinic compounds ranging from methane to high molecular weight modules comprising up to 200 carbon atoms, or, under particular circumstances, even more. Synthesis gas or syn gas is a mixture of hydrogen and carbon monoxide that is obtained by conversion of a hydrocarbonaceous feedstock. Suitable feedstock include natural gas, crude oil, heavy oil fractions, coal, biomass and lignite. Processes to convert the hydrocarbon feedstock to synthesis gas include gasification, steam reforming, auto-thermal reforming and (catalytic) partial oxidation.

While the products obtained in a Fischer-Tropsch synthesis have attractive properties, for example low levels of contaminants like sulphur and nitrogen, they generally have a too high melting point to be directly suitable for general use as liquid fuels or lubricants. Therefore, especially the higher-boiling fractions are generally subjected to an upgrading step. The upgrading step is intended to effect one or more of a decrease in viscosity, a decrease in pour point or cloud point, and a decrease in (end) boiling point.

In the art, products obtained from a Fischer-Tropsch process are often subjected to a hydrocracking step followed by a fractionation step. One or more boiling point fractions of the hydrocracked product can be subjected to a dewaxing step.

There is need for improvement of this process, and the present invention provides such an improved process. More in particular for certain applications there is a need to lower the aromatics content of the products and for other applications there is a need to increase the yield of intermediate product (waxy raffinate). This will be further explained in the text below.

SUMMARY OF THE INVENTION

The present invention pertains to a process for the conversion of a paraffinic feedstock that comprises at least 50 wt % of compounds boiling above 370° C. and which has a paraffin content of at least 60 wt %, an aromatics content of below 1 wt %, a naphthenic content below 2 wt %, a nitrogen content of below 0.1 wt %, and a sulphur content of below 0.1 wt %, which process comprises the steps of:

providing the feedstock to a reaction zone, where it is contacted with hydrogen at a temperature in the range of 175 to 400° C. and a pressure in the range of 20 to 100 bar in the presence of a catalyst comprising 0.005 to 5.0 wt % of a Group VIII noble metal on a carrier, the carrier comprising 0.1-15 wt % of a zeolite beta and at least 40 wt % of an amorphous silica-alumina, calculated on the weight of the catalyst, withdrawing the effluent from the reaction zone through an outlet, subjecting the effluent from the reaction zone to a fractionation step to form at least a heavy fraction, an intermediate fraction, and a light fraction, and providing at least part of the heavy fraction to the inlet of the reaction zone.

In one embodiment of the present invention, the intermediate fraction is subjected to a dewaxing treatment.

In one embodiment, the process of the present invention pertains to a process for the production of waxy raffinate by the conversion of a paraffinic feedstock.

DETAILED DESCRIPTION OF THE INVENTION

In the above the light fraction typically has a T95 between 200 and 420° C., more in particular between 300 and 400° C. T95 is the temperature corresponding to the atmospheric boiling point at which a cumulative amount of 95% of the product is recovered in a gas chromatographic method such as ASTM D2887. The heavy fraction typically has a T5 between 420 and 600° C., more in particular between 450 and 550° C. T5 is the temperature corresponding to the atmospheric boiling point at which a cumulative amount of 5% of the product is recovered in a gas chromatographic method such as, for example ASTM D7169. The intermediate fraction is resultant from the above definition of the light and heavy fraction. The intermediate fraction is also referred to as waxy raffinate or base-oil precursor fraction.

In the process according to the invention one seeks to maximize the yield of the intermediate fraction while at the same time maximizing the conversion of the heavy fraction. Therefore overcracking of the heavy fraction to the light fraction has to be minimized. Products obtained from this process are typically of premium quality compared to their analogues obtained from crude oil by distillation and conversion because of, for example their low aromaticity and water white colour. The low aromaticity makes the products suitable for applications where a low aromatic content is mandatory for environmental or health reasons. The formation of aromatic components in the product is largely influenced by the thermodynamic equilibrium with naphthenes that are formed during the hydroconversion step. Operation at low pressures is favourable for reducing the capital investment cost for the process, but the formation of aromatics and colourization of products increases with decreasing pressures. At a given operating pressure the formation of aromatics and colourization of products obtained by the hydroconversion of Fischer Tropsch Wax increases with temperature. Therefore one seeks to operate at low pressure in combination with low temperature.

It has been found that the process according to the invention gives a high conversion of the fraction with an atmospheric boiling point above 370° C. in combination with low operating temperatures, compared to a similar line-up without the specific catalyst in the reaction zone. More in particular, it has been found that the selection of the specific catalyst in combination with recycle of the heavy fraction results in a high yield of the desirable products. It especially results in a high yield of the intermediate fraction, i.e. the waxy raffinate or base-oil precursor fraction. It more especially results in a high yield of the fraction with an atmospheric boiling point between 370 and 540° C.

It is noted that US2006/0065575 describes a process for preparing a lubricant wherein a wax-containing feedstock is subjected to a hydrocracking step and a dewaxing step, after which a pour point depressant is added. The process described in this reference is stated to be particularly suited to process waxy feedstocks which have a mineral oil source, such as for example slack wax. This feedstock will comprise substantial amounts of nitrogen- and sulphur-containing compounds, and therefore a hydrocracking catalyst comprising a Group VIB metal and a non-noble Group VIII metal is considered preferred. Further, in this document, there is no recycle of part of the hydrocracking effluent to the reaction zone. This recycling is an essential feature of the present invention, because it allows the achievement of very high overall conversions in combination with high yields of desired products (limited overcracking).

U.S. Pat. No. 7,169,291 B1 relates to a hydrocarbon conversion process using a zeolitic catalyst. The catalyst comprises a combination of two base metals; either nickel or cobalt is paired with tungsten or molybdenum. The silica: alumina molar ratio of the beta zeolite in the catalyst is less than 30:1. The document states that the catalyst has an improved selectivity for the production of distillate boiling range hydrocarbons. The typical feed to the process of U.S. Pat. No. 7,169,291 B1 is recovered by fractional distillation from a crude petroleum. The conversion obtained is defined as the yield of hydrocarbons boiling below 371° C. resulting from cracking of feed boiling above 371° C. The 149-371° C. cut distillate yield advantage in shown in the Examples of U.S. Pat. No. 7,169,291 B1. The process of U.S. Pat. No. 7,169,291 B1 thus was designed to have a high yield of product boiling in the range 149-371° C., when converting a crude petroleum fraction. The process of the present invention, on the other hand, is designed to have a high yield of waxy raffinate, especially a high yield of fraction with an atmospheric boiling point between 370 and 540° C., when converting a paraffinic feedstock.

The feedstock used in the present invention is a paraffinic feedstock that comprises at least 50 wt % of compounds boiling above 370° C. and which has a paraffin content of at least 60 wt %, an aromatics content of below 1 wt %, a naphthenic content of below 2 wt %, a nitrogen content of below 0.1 wt %, and a sulphur content of below 0.1 wt %.

Suitable feedstocks can be derived from a feed synthesised in a Fischer-Tropsch process. In one embodiment, they may be obtained, for example, by separating from a Fischer-Tropsch synthesis product part or all of the paraffin fraction boiling above 370° C. In another embodiment they may be obtained, for example, by separating from a Fischer-Tropsch synthesis product part or all of the paraffin fraction boiling above 540° C. In yet another embodiment they may be obtained by combining a Fischer-Tropsch synthesis product with a Fischer-Tropsch derived fraction comprising compounds boiling above 540° C.

In one embodiment the feedstocks described above may be subjected to a hydrogenation step before being sent to the reaction zone.

Preferably, the feedstock comprises at least 60 wt % compounds boiling above 370° C., more in particular at least 70 wt %.

In one embodiment, the feedstock has a substantial amount of components boiling above 540° C. The weight ratio of compounds boiling above 540° C. and compounds boiling between 370 and 540° C. in the feedstock may be at least 0.1:1, preferably at least 0.3:1, more preferably at least 0.5:1.

The feedstock has a paraffin content of at least 60 wt %, more in particular at least 70 wt %, even more in particular at least 80 wt %. The paraffin content of the feedstock is determined by methods known in the art.

The feedstock may contain up to 40 wt % of olefins, oxygenates or combinations thereof, more in particular up to 30 wt %, still more in particular up to 20 wt %.

The feedstock has an aromatics content of less than 1 wt %, more in particular less than 0.5 wt %, still more in particular 0.1 wt % The feedstock has a naphthenic content of less than 2 wt %, more in particular less than 1 wt %.

The feedstock has a sulphur content of less than 0.1 wt %, more in particular less than 0.01 wt %, still more in particular less than 0.001 wt %. %. The feedstock has a nitrogen content of less than 0.1 wt %, more in particular less than 0.01 wt %, still more in particular less than 0.001 wt %.

In the process according to the invention, the feedstock is provided to a reaction zone, where it is contacted with hydrogen at a temperature in the range of 175 to 400° C. and a pressure in the range of 20 to 100 bar in the presence of a catalyst.

In the reaction zone, the feedstock will undergo combined hydrocracking, hydrogenation and isomerisation.

The temperature in the reaction zone will depend on the nature of the feedstock, the nature of the catalyst, the pressure applied, the feed flow rate and the conversion aimed for. In one embodiment, the temperature is in the range of from 250 to 375° C.

The pressure applied in the reaction zone will depend on the nature of the feedstock, the hydrogen partial pressure, the nature of the catalyst, the product properties aimed for and the conversion aimed for. This step may be operated at relatively low pressures, as compared to processes known in the art. Accordingly, in one embodiment the pressure is in the range of 20 to 80 bar, more in particular in the range of 30 to 80 bar. The pressure is the total pressure at the exit of the reactor.

Hydrogen may be supplied at a gas hourly space velocity of from 100 to 10,000 normal liters (NL) per liter catalyst per hour, preferably of from 500 to 5,000 NL/L·hr. The feedstock may be provided at a weight hourly space velocity of from 0.1 to 5.0 kg per liter catalyst per hour, preferably of from 0.5 to 2.0 kg/L·hr.

The ratio of hydrogen to feedstock may range of from 100 to 5,000 NL/kg and is preferably of from 250 to 2,500 NL/kg. Reference herein to normal liters is to liters at conditions of standard temperature and pressure, i.e. at 0° C. and 1 atmosphere.

Hydrogen may be provided as pure hydrogen, or in the form of a hydrogen-containing gas, typically containing more than 50 vol. % of hydrogen, more in particular containing more than 60 vol. % of hydrogen. Suitable hydrogen-containing gases include those from a catalytic reforming, partial oxidation, catalytic partical oxidation, autothermal reforming or any other hydrogen production process, possibly followed by a (catalytic) hydrogen enrichment and/or purification step. Suitably product gas from the reaction zone, rich in molecular hydrogen can be recycled to the feed of the hydroconversion reactor.

The catalyst used in the reaction zone comprises 0.005 to 5.0 wt % of a Group VIII noble metal on a carrier, the carrier comprising 0.1-15 wt % of a zeolite beta and at least 40 wt % of an amorphous silica-alumina, calculated on the weight of the catalyst. It has been found that, in particular, the incorporation of specifically, zeolite beta in the specified amount in a catalyst containing the specified metal component and the specified carrier results in an increased catalyst activity, as can be seen from a reduction of the temperature required to obtain a specified conversion, in combination with an improved selectivity towards the intermediate fraction.

In one embodiment the Group VIII noble metal is selected from platinum, palladium, and mixtures thereof. More in particular, the Group VIII noble metal is platinum. The Group VIII noble metal is present in an amount of 0.005 to 5.0 wt %, calculated as metal on the weight of the catalyst. In particular, the Group VIII noble metal is present in an amount of at least 0.02 wt %, more in particular in an amount of at least 0.05 wt %, still more in particular in an amount of at least 0.1 wt %. In particular, the Group VIII noble metal is present in an amount of at most 2.0 wt %, more in particular in an amount of at most 1 wt %.

The catalyst comprises 0.1-15 wt % of a zeolite beta. Zeolite beta and its characteristics are well known in the art. It is a synthetic crystalline aluminosilicate, with a three dimensional pore system consisting of channels built up from 12-membered rings. The silica:alumina molar ratio is at least 5. The structure of zeolite beta has been characterized to be a highly faulted intergrowth of polymorphs, of which polymorph type A and polymorph type B are the dominant ones. A description of the zeolite beta structure can be found in various articles i.e. J. B. Higgins, R. B. LaPierre, J. L. Schlenker, A. C. Rohrman, J. D. Wood, G. T. Kerr and W. J. Rohrbaugh, Zeolites 1998 Volume 8 p. 446 and J. M. Newsam, M. M. J. Treacy, W. T. Koetsier and C. B. de Gruyter, Proc. R. Soc. Lond. A 1988, vol 420, p 375.

Zeolite Beta is commercially available, for example from PQ Corporation, Zeochem AG and Sud-Chemie Group. The zeolite beta as used in the reaction-zone catalyst has a silica: alumina molar ratio, or SAR, which is generally at least 10, more in particular at least 50, still more in particular at least 75, even more in particular at least 100. The silica:alumina molar ratio of the zeolite beta is generally at most 500, more in particular at most 300, still more in particular at most 200.

The zeolite beta is present in an amount of 0.1-15 wt %, calculated on the weight of the catalyst. More in particular, it is present in an amount of at least 0.5 wt %, still more in particular in an amount of at least 1 wt %. The zeolite beta is in particular present in an amount of at most 10 wt %, still more in particular in an amount of at most 8 wt %, even more in particular in an amount of at most 4 wt %.

It has been found that upon increasing the amount of zeolite beta in the catalyst, the degree of isomerisation of the middle distillate range products decreases. A higher normal paraffin content (and lower degree of isomerisation) has a negative impact on the cloud point and pour point of the product. Sufficient isomerisation is of importance, as for fuels, especially those resulting from the middle distillates fraction, good cold flow properties, such as pour point or cloud point, are desired.

The catalyst contains at least 40 wt % of an amorphous silica-alumina. The silica-alumina may have an alumina content, calculated as $Al_2O_3$ of 5-70 wt %, more in particular in the range of 10-60 wt %.

If so desired, the catalyst may contain up to 40 wt % of a binder, for example to enhance the strength of the catalyst. The binder can be non-acidic. Examples of suitable binders are clay, silica, titania, zirconia, alumina, mixtures and combinations of the above and other binders known to one skilled in the art. The use of an alumina binder, more in particular a gamma-alumina binder may be preferred.

Whether or not a binder will be used, and the amount of binder used, depends, int. al., on the binding properties of the silica-alumina itself. If these are insufficient to provide a particle of adequate strength, a binder will be used.

In one embodiment, the catalyst contains at least 55 wt % of silica-alumina, at least 70 wt % of silica-alumina, or even at least 90 wt % of silica-alumina.

The catalyst can be prepared by processes known in the art. The following describes a general procedure.

In a first step, zeolite beta, the silica-alumina, and when used, the binder, are mixed. This can be done in several ways. It is, e.g., possible to first mix the binder and the zeolite beta, followed by mixing of the silica-alumina with the mixture of binder and zeolite beta. However, it is also possible to first mix the binder and the silica-alumina, e.g., to form a dispersion of silica-alumina in alumina, followed by addition of the zeolite beta. Finally, it is also possible to combine the silica-alumina, the binder if used, and the zeolite beta in a vessel and mix all three compounds simultaneously. After this mixing step the mixture is shaped into particles, e.g., by extrusion or pelleting or spray drying. Generally, the shaped particles are subjected to a drying step e.g. at a temperature between 100-250° C. for a period of 0.5-4 hours, and a calcination step, e.g., at a temperature of 550 to 900° C., for a period of 1-12 hours, in an oxygen-containing atmosphere, more in particular at a temperature of 650 to 800° C.

The Group VIII metal components can, e.g., be incorporated into the catalyst composition by impregnating the shaped particles with an impregnating solution containing precursors of the hydrogenation metal components to be introduced. For example, the carrier particles may be impregnated via pore volume impregnation with an impregnation solution comprising a soluble salt or complex of the Group VIII noble metal or metals. Suitable salts or complexes are, e.g., chloroplatinic acid, platinum tetramine nitrate, platinum dichloride, platinum tetrachloride hydrate, platinum acetylacetonate and palladium dichloride, palladium acetate, palladium tetramine nitrate, palladium acetylacetonate, palladium chloride ethylenediamine. Preferably the carrier particles are impregnated, most preferably via pore volume impregnation, with an impregnation solution comprising chloroplatinic acid, platinum tetramine nitrate, palladium dichloride, or palladium tetramine nitrate. Most preferably the carrier particles are impregnated, even more preferably via pore volume impregnation, with an impregnation solution comprising platinum tetramine nitrate or palladium tetramine nitrate. Additional components can be added to the solution to stabilise the solution or to influence the distribution of the metal over the carrier. The metals-containing particles may be dried, e.g., at a temperature of 50-200° C. in an oxygen-containing atmosphere, for a period of 0.1-10 hours, and subjected to a final calcination for a period of, e.g., 0.1 to 10 hours at a temperature of generally 210-750° C., preferably of 400-550° C. in an oxygen-containing atmosphere.

Alternatively, it is, e.g., also possible to add precursors of metal components during or subsequent to the above-described mixing step and prior to the shaping step. In that case, the shaped particles may be subjected to a calcination step for a period of, e.g., 0.1 to 10 hours at a temperature of generally 550-750° C. in an oxygen-containing atmosphere.

The physical properties of the catalyst generally include: an overall pore volume ($H_2O$) in the range of 0.5 to 1.5 ml/g, and a specific surface area in the range of 100 to 1000 $m^2/g$.

The pore volume of the catalyst can be measured by filling the pore volume with $H_2O$. The pore volume and pore size distribution can be measured by mercury intrusion, for example by ASTM D4641. The pore volume as measured by $H_2O$ intrusion is typically in the range of 0.5 to 1.5 ml/g. In one embodiment, the catalyst has a relatively large overall pore volume, i.e. at least 0.8 ml/g, preferably at least 0.9 ml/g. The pore volume as measured by Hg intrusion (140° contact angle) may, for example, be in the range of 0.5-1.1 ml/g or preferably in the range of 0.7-0.9 ml/g.

In one embodiment, the catalyst has a median pore diameter (Hg) of at least 50 Å and at most 100 Å, more in particular between 60 and 85 Å.

The surface area is determined by BET nitrogen adsorption, e.g., in accordance with ASTM D3663. and expressed in $m^2$ surface area per gram. The catalyst typically has a specific surface area in the range of 100 to 1000 $m^2/g$.

The catalyst particles may have many different shapes. Suitable shapes generally include spheres, cylinders, rings, and symmetric or asymmetric polylobes, for instance tri- and quadrulobes. The particles usually have a diameter in the range of 0.5 to 10 mm, more in particular in the range of 1 to 3 mm, and their length is in the range of 0.5 to 10 mm, in particular 3 to 8 mm.

Prior to being used, the catalyst may be subjected to a reduction step in order to convert the noble metal to the metallic form. Such a reduction step may be carried out via an otherwise conventional route by treating the catalyst at elevated temperature with hydrogen or a gaseous mixture predominantly made up of hydrogen. The most practical course of action is for the reduction step to be carried out in the reactor in which the process according to the invention is to be performed.

The effluent from the reaction zone is subjected to a fractionation step to form at least a heavy fraction, an intermediate fraction, and a light fraction.

In the context of this specification, the light fraction typically has a T95 between 200° C. and 420° C., more preferably between 300° C. and 400° C. T95 is the temperature corresponding to the atmospheric boiling point at which a cumulative amount of 95% of the product is recovered in a gas chromatographic method such as ASTM D2887. The heavy fraction typically has a T5 between 420 and 600° C., more preferably between 450 and 550° C. T5 is the temperature corresponding to the atmospheric boiling point at which a cumulative amount of 5% of the product is recovered in a gas chromatographic method such as, for example ASTM D7169. The intermediate fraction is resultant from the above definition of the light and heavy fraction.

Suitably the light fraction is separated in the same fractionation step or in additional steps, in a number of products with a narrower boiling point range, for example the naphtha range, the kerosene range and/or the gasoil range. Generally, a gaseous fraction, i.e., a fraction 80% of which boils below 25° C. will also be separated off.

At least part of the heavy fraction is provided to the inlet of the reaction zone. Optionally, part or all of the intermediate fraction may be recycled. In one embodiment the intermediate fraction and the heavy fraction are obtained as one stream from the fractionation step and partly or fully recycled. Typically, the conversion of the heavy fraction per pass through the reactor will be optimal between 35 and 80 wt %.

In one embodiment of the present invention the intermediate fraction, sometimes referred to as waxy raffinate, is, in whole or in part, provided to a second zone for a dewaxing treatment. The purpose of the dewaxing treatment is to reduce the pour point of the waxy raffinate to at least −12° C., preferably at least −18° C., more preferably at least −24° C. These types of dewaxing treatments are well known to those skilled in the art and include solvent dewaxing, catalytic dewaxing or a combination thereof. In one embodiment, at least part of the intermediate fraction is provided to a catalytic dewaxing zone where it is contacted with a dewaxing catalyst and hydrogen at elevated temperature and pressure. Catalytic dewaxing may be any process wherein in the presence of a catalyst and hydrogen the pour point of the waxy raffinate is reduced. Preferably, in a catalytic dewaxing process straight chain paraffins and slightly branched paraffins, i.e. paraffins with only a limited number of branches, are isomerized without a too large degree of conversion into lower boiling products.

Catalysts suitable for application in this zone include conventional dewaxing catalysts. Suitable dewaxing catalysts are heterogeneous catalysts comprising a molecular sieve, optionally in combination with a metal having a hydrogenation function, such as a Group VIII metal component. Molecular sieves, and more suitably intermediate pore size zeolites, have shown a good catalytic ability to reduce the pour point of the waxy raffinate under catalytic dewaxing conditions. Preferably the intermediate pore size zeolites have a pore diameter of between 0.35 and 0.8 nm. Suitable intermediate pore size zeolites are mordenite, ZSM-5, ZSM-12, ZSM-22, ZSM-23, SSZ-32, ZSM-35 and ZSM-48. Another preferred group of molecular sieves are the silica-aluminaphosphate (SAPO) materials such as SAPO-11. The aluminosilicate zeolite crystallites may be modified by a dealumination treatment.

Suitable Group VIII metals are nickel, cobalt, platinum and palladium. Examples of possible combinations are Pt—ZSM-35, Ni—ZSM-5, Pt/ZSM-23, Pt/ZSM-48 and Pt/SAPO-11.

The dewaxing catalyst may suitably also comprise a binder. The binder can be a synthetic or naturally occurring (inorganic) substance such as clay and/or metal oxides. Examples are alumina, silica-alumina, silica-magnesia, silica, titania, zirconia, alumina, mixtures and combinations of the above and other binders known to one skilled in the art.

The temperature in the dewaxing zone will depend on the nature of the feedstock, the pressure applied, the nature of the catalyst, the feed flow rate and the pour point reduction aimed for. In one embodiment, the temperature is in the range of from 200 to 500° C., more preferably of from 250 to 400° C.

The pressure applied in the dewaxing zone will depend on the nature of the feedstock, the nature of the catalyst, and the conversion aimed for. In one embodiment, the pressure is in the range of from 10 to 100 bar, more preferably of from 40 to 70 bar. The pressure is the hydrogen partial pressure.

Hydrogen may be supplied at a gas hourly space velocity of from 100 to 10,000 normal liters (NL) per liter catalyst per hour, preferably of from 500 to 5,000 NL/L·hr. The feedstock may be provided at a weight hourly space velocity of from 0.1 to 10.0 kg per liter catalyst per hour, preferably of from 0.5 to 3.0 kg/L·hr.

The ratio of hydrogen to feedstock may range of from 100 to 5,000 NL/kg and is preferably of from 250 to 2,500 NL/kg. Reference herein to normal liters is to liters at conditions of standard temperature and pressure, i.e. at 0° C. and 1 atmosphere.

Solvent dewaxing is well known to those skilled in the art and involves admixture of one or more solvents and/or wax precipitating agents with the intermediate fraction and cooling the mixture to a temperature in the range of from −10° C. to −40° C., preferably in the range of from −20° C. to −35° C., to separate the wax from the oil. The oil containing the wax is usually filtered through a filter cloth which can be made of textile fibres, such as cotton; porous metal cloth; or a cloth made of synthetic materials.

Examples of solvents which may be employed in the solvent dewaxing process are $C_3$-$C_6$ ketones (e.g. methyl ethyl ketone, methyl isobutyl ketone and mixtures thereof), $C_6$-$C_{10}$ aromatic hydrocarbons (e.g. toluene) mixtures of ketones and aromatics (e.g. methyl ethyl ketone and toluene), autorefrigerative solvents such as liquefied, normally gaseous $C_2$-$C_4$ hydrocarbons such as propane, propylene, butane, butylenes and mixtures thereof. Mixtures of methyl ethyl ketone and toluene or methyl ethyl ketone and methyl isobutyl ketone are generally preferred.

The solvents may be recovered from the wax and the lubricating baseoil and recycled into the process. For example, the solvents may be recovered from the wax and the lubricating baseoil by filtration and recirculation of the solvents into the process.

The wax that is separated in the solvent de-waxing process may be recycled to the reaction zone, or alternatively, may be sent to a hydroisomerisation stage if for example, the pour point reducing treatment involves both a solvent dewaxing stage and a hydroisomerisation stage. The wax may be subjected to a deoiling treatment prior to recycling. Another possibility is to fractionate the wax and sell one or more of the fractions on the wax market. Fractionation is typically effected during short path distillation.

The dewaxed product may be fractionated in separate streams with different boiling ranges and is suitable for use as a base oil for lubricant formulations.

The present invention will be elucidated with reference to the following examples, without being limited thereto or thereby.

Example 1

Three catalysts were prepared, one comparative catalyst and two catalysts according to the invention. Comparative catalyst A contained 0.8 wt % of platinum on a carrier containing 70 wt % of silica-alumina (alumina content of 29 wt %), and 30 wt % of alumina binder. The carrier had an Hg-pore volume (60 k-atm) of 0.83 ml/g, and a nitrogen BET surface area of 382 $m^2$/g. Catalyst B according to the invention was similar to Catalyst A, except that it contained 2 wt % of zeolite beta and 68 wt % of silica-alumina.

Catalyst C according to the invention was similar to Catalyst A, except that it contained 4 wt % of zeolite beta and 66 wt % of silica-alumina. A commercially available zeolite beta with a silica:alumina molar ratio of 100 was used for the synthesis.

All catalysts were manufactured in accordance with the following procedure: silica-alumina, alumina, and, if present, zeolite beta were mixed together with water and extrusion aids to form a shapeable dough. The dough was formed into particles by way of extrusion. The particles were dried at a temperature of 180-250° C., and calcined at a temperature of 700-720° C. for a period of 2 hours. The particles were impregnated with an impregnation solution containing the concentration of platinum tetramine nitrate required to arrive at a loading of 0.8 wt % of platinum. The impregnated particles were dried in air at a temperature of 180° C., and calcined at a temperature of 450° C. for a period of 2 hours.

Example 2

Catalyst A as described above was tested using a representative Fischer Tropsch Feed. The Fresh Feed was composed of a light (<370° C.) and heavy (>370° C.) stream and contained 77 wt % of material with an atmospheric boiling point above 370° C. and 53 wt % of material with an atmospheric boiling point above 540° C., as determined by ASTM D2887 and D7169-05 on the individual streams.

The catalyst particles were mixed in a 1:1 v/v ratio with silicon carbide and a total catalyst quantity corresponding to 260 ml was loaded into the reactor. A total pressure of 60 bar was applied. Hydrogen with a purity of >99% was added with a gas-hourly-space-velocity of 1000 Nl/lcatalyst/h. The fresh liquid feed weight-hourly-space-velocity was 0.8 kg/lcatalyst/h.

The reaction products were separated into a gaseous stream, a light liquid fraction and intermediate liquid fraction and a heavy liquid fraction. Each fraction was analysed separately. The gaseous fraction was analysed with an online GC, the liquid fractions were collected over 24 hour periods and analysed by ASTM D 2887 (light fraction), SMS2551 (intermediate fraction, an in-house method based on ASTM D2887) and ASTM D7169-05 (heavy fraction). The total product yield was calculated on the compositional data obtained for each stream and the quantity of hydrocarbon product in each stream. The conversion level was determined using atmospheric boiling point distributions for liquid feed and hydrocarbon products. The conversion 540° C.+ material in the feed was varied by changing the Weight Average Bed Temperature over the reactor. The yield of the 370° C.-540° C. fraction in the total product at an overall conversion of 540° C.+ material of 95 wt % was calculated on the basis of the generated data.

In experiment 2-1 no recycle of products to the inlet of the reactor was applied.

In experiment 2-2, the heavy fraction was fully recycled to the inlet of the reactor. The heavy fraction had a T5 of around 495° C. and a T10 of around 540° C. The recycle rate was chosen such that no accumulation of the heavy fraction in the system took place.

The results obtained in the above experiments are given in Table 1. These results show that recycling of the heavy fraction containing a substantial amount of material with an atmospheric boiling point that is higher than 540° C. results in a much higher yield of the fraction with an atmospheric boiling point between 370 and 540° C. This is achieved by limiting the conversion of the heavy fraction per pass through the reactor, while maintaining a high overall conversion of the heavy fraction. In practise the conversion of the heavy fraction per pass through the reactor will be optimized between the hydrodynamic load on the reactor that increases at low conversion per pass of the heavy fraction and the maximisation of the yield of the intermediate fraction that decreases at high conversion per pass of the heavy fraction. Typically, the conversion of the heavy fraction per pass through the reactor will be optimal between 35 and 80 wt %.

TABLE 1

| | Experiment 2-1 Once Through | Experiment 2-2 Recycle |
|---|---|---|
| Overall Conversion of 540° C.+ fraction in feed (wt % on FF) | 95 | 95 |
| Yield of 370-540° C. fraction (wt % on FF) | 5 | 24 |

FF = fresh feed (excluding recycle)

Example 3

Catalysts A, B and C given in example 1 were tested in a hydroprocessing unit using a representative Fischer-Tropsch feed of which 85% had an atmospheric boiling point above 370° C. and 45% had an atmospheric boiling point above 540° C. as determined by a gas chromatography method based on ASTM D 7169-05. The catalyst particles were mixed in a 1:1 v/v ratio with silicon carbide and a total catalyst quantity corresponding to 50 ml was loaded into the testing unit. The reaction conditions included a total operating pressure of 38 barg, a hydrogen gas-hourly-space-velocity of 1000 Nl/lcatalyst/h and a weight-hourly-space-velocity of 1 kg/lcatalyst/h. The boiling point distributions of liquid products were measured using methods based on ASTM D 7169-05 and ASTM D 2887, whereas the gas phase product composition was measured using online gas chromatography. The aromatics content in the liquid 370° C. minus fraction was measured using an in-house method based on UV spectroscopy. The reaction temperature was adapted to the desired conversion level of feed with an atmospheric boiling point of ≥370° C. (the ≥"370° C. fraction").

The conversion of the ≥370° C. fraction was determined using atmospheric boiling point distributions for liquid feed and hydrocarbon products. From the obtained results at various operating temperatures, the temperature required for the conversion of 50% of the ≥370° C. fraction was calculated by interpolation. Table 2 shows results that were obtained for the comparative catalyst A, and catalysts B and C according to the present invention.

TABLE 2

| | Catalyst A | Catalyst B | Catalyst C |
|---|---|---|---|
| Zeolite beta content (wt %) | 0 | 2 | 4 |
| Temperature required for 50 wt % of the ≥370° C. fraction (° C.) | 325 | 314 | 302 |
| Mono-Naphthene content in effluent (wt %) | 1.7 | 1.5 | 1.7 |
| Keq Toluene/ Methylcyclohexane in hydrogen $(mol/m^3)^3$ | $13.1 \cdot 10^5$ | $5.4 \cdot 10^5$ | $2.3 \cdot 10^5$ |
| Measured Aromatic content in the liquid <370° C. fraction (ppmwt) | 614 | | 115 |

The temperature required for 50% conversion of 370° C.+ material present in the feed can be seen as a measure for the activity that is displayed by a hydrocracking catalyst. The lower the temperature required to reach 50% conversion of the 370° C.+ material present, the higher the activity of the catalyst. The test results demonstrate that the activity can be increased significantly by addition of small but distinct amounts of zeolite beta to a hydrocracking catalyst. Addition of 2 and 4 wt % zeolite beta resulted in a decrease in temperature required for 50% conversion of 370° C.+ material by 11 and 23° C., respectively, compared to the comparative catalyst A.

In the hydroprocessing step hydrocracking, hydrogenation and hydroisomerisation of the Fischer Tropsch feed takes place. This is accompanied by the formation of ring structures. As an example, the amount of mono-naphthenes in the total liquid product for each of the catalysts is also given in Table 2. The mono-naphthene content was determined by a method based an GCxGC technique as described in Blomberg et al. J. High Resol. Chromatogr. 20 (1997) p. 539. The final content of aromatics that is found in a hydrocracked product is impacted by the thermodynamic equilibrium that is present between aromatics and naphthenics (reference: A. Chauvel, Petrochemical processes volume 1, Gulf Pub. Co., Editions Technip, 1989, p 166). Raising the hydrogen partial pressure or lowering of the reactor temperature, or a combination of these two process parameters, shifts the equilibrium towards the direction of naphthenics and hence favours the production of hydrocracker product that have lower aromatics concentrations. As an example thereof, the thermodynamic equilibrium between toluene and methylcyclohexane, is also given in Table 2 at the temperature required for 50% conversion of 370° C.+ material in the experiments. This equilibrium constant was calculated using the programme HSC chemistry v 5.11 (T. Talonen, J. Eskelinen, T. Syväjärvi and A. Roine, HSC Chemistry v. 5.11 (32-bit version), Equilibrium Composition module 5.1, Outokumpu Research Oy, Pori, Finland), with starting conditions 999 kmol hydrogen, 1 kmol methylcyclohexane and total pressure of 38 bar. The equilibrium constant shows that the trend in the aromatics content at constant naphthene content and pressure decreases with decreasing temperature. This means that at lower temperature, a smaller proportion of the hydrocarbon ring structures present in the effluent of the hydroprocessing step can expected to be converted to aromatics. The experimental data in table 2 for total aromatic content in the liquid 370° C. minus product is in agreement with this trend.

The above shows that the activity gain is not only beneficial as it increases energy efficiency of the hydrocracking process as lower process temperatures can be used, but it also shows to be advantageous in combination with the production of Fischer-Tropsch derived hydrocracker product that is low in aromatics while maintaining a low hydrogen partial pressure in the reactor. This low aromatic content is of particular importance when considering applications where a low aromatic content is mandatory for environmental or health reasons, where specifications of <0.1 wt % aromatics in the product are not uncommon.

Example 4

Catalysts A, B and C given in example 1 were tested in a hydroprocessing unit and using the feedstock as described in example 3. The analytical methods used to determine the atmospheric boiling point distributions of the gaseous and liquid products are similar to those used in Example 3. The reaction temperature was adapted to the desired conversion level of feed with an atmospheric boiling point of ≥370° C. At each conversion level of the ≥370° C. fraction, the yield of the different product fractions was determined from the boiling point distributions obtained by sampling and analysis of the offgas and liquid products. From these data, the yield profile at 50% conversion of the ≥370° C. fraction was calculated by interpolation. The ratio between branched C18 molecules (iso-paraffins) and linear C18 molecules (normal-paraffins) in the total product was determined by a method based an GC×GC technique as described in Blomberg et al. J. High Resol. Chromatogr. 20 (1997) p. 539. This ratio is regarded as a good indicator for the degree of isomerisation in the middle distillate product. These results are given in Table 3.

TABLE 3

Yield profile calculated at 50% conversion of the fraction of the feed with an atmospheric boiling point above 370° C.+

| | Catalyst A | Catalyst B | Catalyst C |
|---|---|---|---|
| Zeolite beta content (wt %) | 0 | 2 | 4 |
| "middle distillates" yield (wt %); (boiling range of 150-370° C.) | 43.4 | 44.3 | 44.4 |
| "waxy raffinate" yield (wt %) (boiling range of 370-540° C.) | 23.8 | 27.4 | 28.2 |
| ≥540° C. (wt %) | 20.0 | 15.2 | 14.4 |
| Iso paraffin/ | 9.2 | 7.4 | 5.7 |

TABLE 3-continued

| Yield profile calculated at 50% conversion of the fraction of the feed with an atmospheric boiling point above 370° C.+ | | | |
|---|---|---|---|
| | Catalyst A | Catalyst B | Catalyst C |
| normal paraffin ratio of C18 | | | |

Table 3 shows that the yield of hydrocracker product with an atmospheric boiling point between 370 and 540° C. is higher for catalysts B and C made according to the invention than the yield obtained when using comparative catalyst A. This increase in yield of the fraction with an atmospheric boiling point between 370 and 540° C. for catalysts B and C compared to catalyst A, is accompanied by a decrease in the yield of the fraction with a boiling point ≥540° C. The yield in the fraction with a boiling point between 150 and 370° C., or middle distillates fraction, is only slightly affected by the incorporation of zeolite beta. This demonstrates that the yield of the intermediate fraction, or waxy raffinate, in this case with a boiling range between 370-540° C. can be maximized by the incorporation of small but distinct amounts of zeolite beta. This intermediate fraction can then, in analogy with the invention, be sent to a dewaxing treatment after which a valuable baseoil is obtained.

Table 3 shows that the ≥540° C. yields for catalyst B and C are lower than that of catalyst A. Thus, the inclusion of the zeolite beta component, which has relatively small pores due to its 12-membered-ring pore geometry, surprisingly results in an improved cracking of the heavy molecules present in the ≥540° C. fraction. As indicated in Example 2, it was found that recycle of the 540° C.+ fraction is beneficial to the overall WR yield that is obtained. In this embodiment, a combined feed is fed to the hydrocracking reactor, which consists of a mixture of fresh feed and unconverted 540° C.+ material that is recycled. Because catalyst B and C display an improved cracking of the ≥540° C. recycle fraction compared to catalyst A, the recycle flow of ≥540° C. material will decrease allowing an increase in the overall fresh feed throughput. Thus a higher fresh feed intake can be accommodated, while keeping the reactor load and hydraulics similar.

Table 3 further shows that upon increasing the amount of zeolite beta in the catalyst, the degree of isomerisation of the middle distillate range products, as represented by the ratio between iso paraffin C18 and normal paraffin C18, decreases. A higher normal paraffin content (and lower degree of isomerisation) has a negative impact on the cloud point and pour point of the product. Sufficient isomerisation is of importance, as for fuels, especially those resulting from the middle distillates fraction, good cold flow properties, such as pour point or cloud point, are desired.

Table 3 also demonstrates that, although zeolite beta may be present in the carrier in an amount up to 15 wt %, the optimum result in this example has been obtained with the sample having 2 wt % of zeolite beta in the carrier. This sample showed a high yield of the intermediate fraction compared to the catalyst without zeolite beta, while at the same time showing a better isomerisation degree as compared to the sample having 4 wt % of zeolite beta in the carrier.

What is claimed is:

1. A process for the conversion of a paraffinic feedstock that comprises at least 50 wt % of compounds boiling above 370° C. wherein the weight ratio of compounds boiling above 540° C. and compounds boiling between 370 and 540° C. in the feedstock is at least 0.3:1 and which has a paraffin content of at least 60 wt %, an aromatics content of below 1 wt %, a naphthenic content below 2 wt %, a nitrogen content of below 0.1 wt %, and a sulphur content of below 0.1 wt %, which process comprises the steps of:

providing the feedstock to a reaction zone where it is contacted with hydrogen at a temperature in the range of 175 to 400° C. and a pressure in the range of 20 to 100 bar in the presence of a catalyst comprising 0.005 to 5.0 wt % of a Group VIII noble metal on a carrier, the carrier comprising 0.1-15 wt % of a zeolite beta and at least 40 wt % of an amorphous silica-alumina, calculated on the weight of the catalyst, said zeolite beta having a silica: alumina molar ratio of at least 50, and said amorphous silica-alumina having an alumina content, calculated as $Al_2O_3$, of 5-70 wt %;

withdrawing the effluent from the reaction zone through an outlet;

subjecting the effluent from the reaction zone to a fractionation step to form at least a heavy fraction, an intermediate fraction with a boiling range of 370-540° C., and a light fraction; and providing at least part of the heavy fraction to the inlet of the reaction zone.

2. A process according to claim 1, wherein the intermediate fraction is provided to a dewaxing zone.

3. A process according to claim 1 wherein the feedstock comprises at least 60 wt % compounds boiling above 370° C.

4. A process according to claim 1 wherein the Group VIII noble metal on the catalyst is selected from the group consisting of platinum, palladium, and mixtures thereof.

5. A process according to claim 1 wherein the zeolite beta in the catalyst is present in an amount of at least 0.5 wt % and in an amount of at most 10 wt %.

6. A process according to claim 1 wherein the zeolite beta in the catalyst has a silica:alumina molar ratio of at least 75 and at most 500, calculated as $SiO_2$ and $Al_2O_3$.

7. A process according to claim 2 wherein at least part of the intermediate fraction is provided to a catalytic dewaxing zone where it is contacted with a dewaxing catalyst and hydrogen.

8. A process according to claim 7 wherein the dewaxing catalyst comprises a molecular sieve in combination with a metal having a hydrogenation function.

* * * * *